US006644790B2

(12) United States Patent
Ozaki et al.

(10) Patent No.: US 6,644,790 B2
(45) Date of Patent: Nov. 11, 2003

(54) INK-JET HEAD SUBSTRATE, INK-JET HEAD AND INK-JET RECORDING APPARATUS

(75) Inventors: Teruo Ozaki, Kanagawa (JP); Masami Kasamoto, Kanagawa (JP); Shuji Koyama, Kanagawa (JP); Junichiro Iri, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/916,473

(22) Filed: Jul. 30, 2001

(65) Prior Publication Data

US 2002/0024565 A1 Feb. 28, 2002

(30) Foreign Application Priority Data

Jul. 31, 2000 (JP) ..... 2000-232407

(51) Int. Cl.[7] ..... B41J 2/05
(52) U.S. Cl. ..... 347/64
(58) Field of Search ..... 347/64, 63

(56) References Cited

U.S. PATENT DOCUMENTS 4,513,298 A * 4/1985 Scheu ..... 347/64
4,686,544 A 8/1987 Ikeda et al.
4,723,129 A 2/1988 Endo et al.
4,740,796 A 4/1988 Endo et al.
5,057,856 A 10/1991 Takagi et al.
5,831,648 A 11/1998 Mitani et al. ..... 347/62
6,139,131 A * 10/2000 Prasad et al. ..... 347/63
6,293,654 B1 * 9/2001 Pidwerbecki ..... 347/64

FOREIGN PATENT DOCUMENTS

JP 2683350 8/1997
WO WO 98/30642 7/1998

* cited by examiner

*Primary Examiner*—Judy Nguyen
*Assistant Examiner*—Michael S Brooke
(74) *Attorney, Agent, or Firm*—Fitzpatrick, Cella, Harper & Scinto

(57) ABSTRACT

To provide an ink-jet head substrate enabling both highly koge. characteristic ink and corrosive ink to be used, an ink-jet head using the same basis and an ink-jet recording apparatus equipped with the same head. The ink-jet head substrate includes: heat generating resistors forming heat generating sections on a base; electrode wires electrically connected to the heat generating resistors; and anti-cavitation films installed via an insulator protective layer on the heat generating resistors and the electrode wires, in which the anti-cavitation film is formed of materials varying with individual given areas on the base.

12 Claims, 6 Drawing Sheets

INK-JET HEAD SUBSTRATE, INK-JET HEAD AND INK-JET RECORDING APPARATUS

BACKGROUND OF THE INVENTION

1. Field of the Invention

The present invention relates to an ink-jet head for discharging ink to make recording, a substrate for use with the same head and an ink-jet recording apparatus.

2. Related Background Art

The ink-jet recording style disclosed in U.S. Pat. No. 4,723,129 or U.S. Pat. No. 4,740,796 enables high precision and high image quality recording at high speed and high density and suits for coloring and compacting. An ink-jet recording apparatus making use of this ink-jet recording style for bubbling ink with the aide of thermal energy and for discharging the ink to a recording medium generally comprises an ink-jet head substrate with heat generating resistors for bubbling the ink and wires for effecting an electric connection thereto fabricated on one and the same substrate to make an ink-jet recording head usable substrate and further a nozzle for discharging the ink formed thereon.

And, to save the electric energy to be invested on one hand and on the other hand, to prevent a decrease in the service life of the substrate both due to the mechanical damage accompanying the bubbling of ink and due to the breakage of a heater section on action of heating pulses, various contrivances are made to this ink-jet recording head substrate. Above all, with respect to a protective film for protecting the heating resistor having a heat generating section positioned between a pair of wiring patterns from the ink, many contrivances are accomplished.

From the viewpoint of thermal efficiency, higher thermal conductivity or a thinner film is advantageous in this protective film. On the other hand, however, the protective film serves to protect the wires connected to a heat generating body from the ink, a thicker film is advantageous if considered from the probability of defects in the film. From the competitive viewpoint of energy efficiency and reliability, the film thickness is set to the most suitable value. Incidentally, the protective film is subject to both cavitation damages, i.e. mechanical damages, due to the bubbling of ink and damages due to the chemical reaction with an ink component at higher temperatures, originating in that the surface after the bubbling reaches high temperatures.

For this reason, an insulating film for protecting the wire and a film stable against mechanical and chemical damages are hardly compatible in practice and therefore it is general to form a film stable against mechanical and chemical damages due to the bubbling of ink at the upper layer and to form an insulating film for protecting the wire at the lower layer. To be specific, it is general to form a Ta film, extremely high in mechanical and chemical stability, at the upper layer and to form an SiN film or an SiO film, whose stable film can be easily formed in an existing semiconductor device, at the lower layer.

To give a detailed account, a SiN film is formed on the wire as the protective film at a thickness of approximately 0.2 to 1 $\mu$m and then an upper protective film, generally, a Ta film referred to as anti-cavitation film in view of function as a film against the cavitation damage, is formed at a thickness of 0.2 to 0.5 $\mu$m. According to this configuration, compatibility between the life of a heat generating resistance in the ink-jet head substrate and the reliability is intended.

Besides, in addition to mechanical and chemical damages as mentioned above, there occurs a phenomenon that coloring materials, contaminants and suchlike contained in the ink are decomposed by heating to higher temperatures at the level of molecules to make a difficult-to-dissolve substance at the heat generating section, which is physically adsorbed to the anti-cavitation film serving as an upper protective film. This phenomenon is known as kogation (hereinafter, referred to as "koge."). When difficult-to-dissolve organic or inorganic substances are adsorbed onto the anti-cavitation film like this, thermal conduction from the heat generating resistance to the ink becomes non-uniform and the bubbling is instabilized. Thus, it is necessary that no "koge." occurs on the anti-cavitation film in the heat generating section, but the above described Ta film is generally adopted as a film relatively good in koge.

Meanwhile, in recent years, a leapt improvement in the performance of an ink-jet printer is demanding not only for an improvement in the performance of ink, e.g. the prevention of bleeding (blotting between the different color ink types) corresponding to high speed recording but also for an improvement in color development and weather resistance corresponding to higher image quality. For this reason, various components are added in ink and various components come to be added in each of three ink colors, Yellow, Magenta and Cyan, ink types forming a color image.

As a result of this, for example, in an ink-jet head with tricolor heat generating sections of Y, M and C and a Ta film as the upper protective film thereof formed on one and the same substrate, a difference in the ink constituents causes a corrosion even for the Ta film that has been considered to be stable before in the heat generating section corresponding to a certain color, thereby further resulting in the occurrence of a phenomenon that even the lower protective layer and the heat generating body are also damaged and broken. In case of using ink containing a divalent metallic salt such as Ca or Mg or the component forming a chelate complex, for example, the Ta film is liable to be corroded by thermo-chemical reaction with the ink.

On the other hand, as corresponds to this improvement in ink constituents, other anti-cavitation film have been developed. When the Ta-containing amorphous alloy exemplified in the Japanese Patent No. 2,683,350 of the present inventor is used, for example, in place of the Ta film, hardly any damage is confirmed to be effected even if any strongly corrosive substance is contained in an ink constituent.

Thus, use of a Ta-containing amorphous alloy can be examined as the upper protective film of the heat generating section in an ink-jet head capable of ejecting tricolor ink types of Y, M and C as mentioned above, but this Ta-containing amorphous alloy film is hardly subject to damages in surface in return for a high ink corrosion resistance, so that a liable tendency of koge. generation is observed by contraries.

Thus, in the heat generating section corresponding to a certain color, the upper protective layer is hardly corroded and instead, a problem of koge. property takes place. In addition to this, a phenomenon that the koge. characteristic, though hardly at issue in a former Ta, becomes noticeable on account of adopting a Ta-containing amorphous alloy never fails to occur. Incidentally, a scanty generation of koge. in a former Ta can be presumed to be attributed to the balanced occurrence of some corrosion and koge. in the former Ta and to the prevention of koge. accumulated generation due to gradual scraping by some corrosion in the Ta film surface.

With an arrangement of adopting either Ta or a Ta-containing amorphous alloy as the upper protective layer in contact with ink, as described above, full attainment of making the service life and the reliability of an ink-jet head compatible which uses highly koge. characteristic ink and corrosive ink depending to each color has become difficult.

Accordingly, in consideration of these actual circumstances, it is an object of the present invention to provide an ink-jet head substrate enabling both highly koge. characteristic ink and corrosive ink to be used, an ink-jet head using the same basis and an ink-jet recording apparatus equipped with the same head.

SUMMARY OF THE INVENTION

In order to attain the above described object, in an ink-jet head substrate, including: a heat generating resistor forming a heat generating section on a base; an electrode wire electrically connected to the heat generating resistor; and an anti-cavitation film installed via an insulator protective layer on the above heat generating resistor and the above electrode wire, the present invention is characterized in that the above described anti-cavitation film is formed of materials varying with individual given areas on the base.

Besides, in an ink-jet head with a plurality of liquid paths communicating with discharge ports for discharging ink droplets installed corresponding to heat generating sections for supplying different types of ink to individual several flow paths on an ink-jet head substrate which comprises: a heat generating resistor forming a heat generating section on a base; an electrode wire electrically connected to the heat generating resistor; and an anti-cavitation film installed via an insulator protective layer on the above heat generating resistor and the above electrode wire; the present invention is characterized in that the above anti-cavitation film is formed of materials varying with individual areas corresponding to types of ink on the base.

Besides, in an ink-jet head substrate, including: a heat generating resistor forming heat generating sections on a base; an electrode wire electrically connected to the heat generating resistor; and an anti-cavitation film installed via an insulator protective layer on the above heat generating resistor and the above electrode wire, the present invention is characterized in that the above described anti-cavitation film is divided into films varying in ink corrosion resistance every predetermined area on the base.

Besides, in an ink-jet head substrate, comprising: a heat generating resistor forming a heat generating section on a base; an electrode wire electrically connected to the heat generating resistor; and an anti-cavitation film installed via an insulator protective layer on the above heat generating resistor and the above electrode wire; the present invention is characterized in that the above anti-cavitation film is divided into films varying in ink corrosion resistance with individual given areas on the base.

In a head substrate and an ink-jet head according to the present invention as mentioned above, the above anti-cavitation film is preferably divided into a Ta film or a TaAl film and a Ta-containing amorphous alloy film for each of the above-mentioned areas.

And, the above Ta-containing amorphous alloy is preferably composed of Ta, Fe, Ni and Cr and those expressed in terms of Composition Formula (I):

$$Ta_{\alpha}Fe_{\beta}Ni_{\gamma}Cr_{\delta} \quad (I),$$

wherein 10 at. %$\leqq\alpha\leqq$30 at. %, $\alpha+\beta<80$ at. %, $\alpha<\beta$, $\delta>\gamma$ and $\alpha+\beta+\gamma+\delta=100$ at. %, are preferred as amorphous alloys.

At heat generating sections of areas in which easily koge. generating ink is used on a head substrate, according to such a composition of the head substrate and the ink-jet head, since use of Ta as a material of the anti-cavitation film in contact with ink suppresses the accumulated generation of koge. on account of a little-by-little scraped anti-cavitation film accompanying an increase in heater drive pulse, the efficiency of bubbling does not decrease. On the other hand, at heat generating sections of areas to which strongly corrosive ink is applied on the head substrate, a Ta-containing amorphous alloy is used as a material of the anti-cavitation film, so that hardly any corrosion takes place. Thus, in case of using a plurality of heat generating sections arrayed in a straight line on the head substrate divisively for different types of ink, the head substrate can attain a sufficient service life and the reliability compatibly for both following types of ink even if ink subject to koge. and ink corrosive to Ta are included in the ink types.

Besides, the present invention also includes an ink-jet recording apparatus comprising a carriage on which to mount the above ink-jet head for discharging ink droplets from the ink-jet head to make recording while moving the carriage corresponding to recording information items.

DETAILED DESCRIPTION OF THE PREFERRED EMBODIMENTS

Figure 1A:
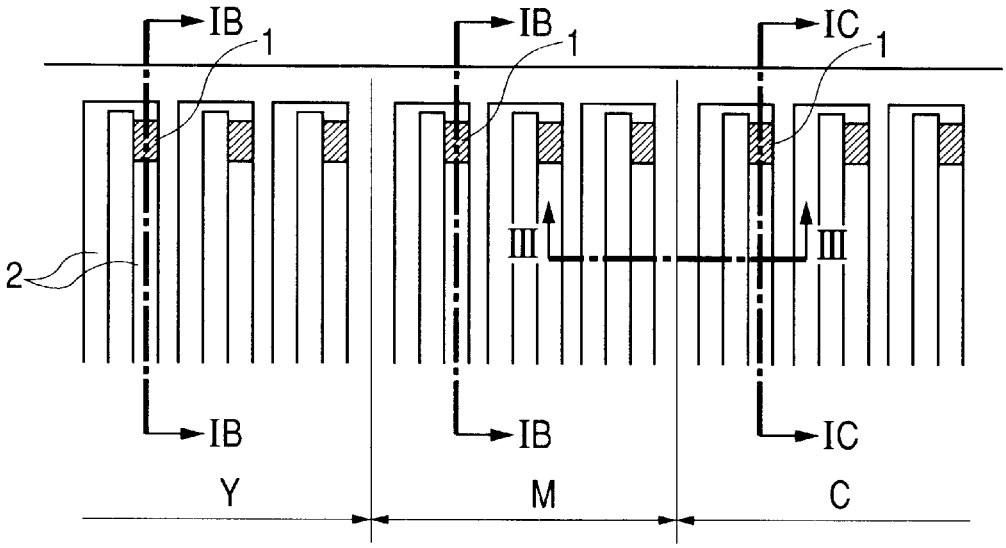
FIGS. 1A, 1B and 1C are illustrations of an ink-jet head substrate according to Embodiment 1 of the present invention.

An ink-jet head according to the present embodiment has ink paths communicating to discharge ports for discharging ink installed on an ink-jet head substrate comprising heat generating resistors forming heat generating sections on a base, wiring electrodes electrically connected to the heat generating resistors and an anti-cavitation film installed via an insulator protective film on the heat generating resistor and the wire, wherein the ink paths are provided for individual ink types so that a plurality of ink types can be used divisively depending on different ink paths. Especially, the anti-cavitation film is composed of film materials varying with individual ink types to be used depending on ink paths, so that the portion corresponding to some types of ink is a Ta-containing amorphous alloy film and that corresponding to other types of ink is a Ta film lower in ink corrosion resistance.

In this embodiment, part of the anti-cavitation film was made of Ta, but any other material may be employed if tends to be gradually corroded. Besides, another part of the anti-cavitation film was made of a Ta-containing amorphous alloy, but the type of material is free of restriction if highly resistant to ink corrosion.

Besides, if an arrangement taking different characteristics of a plurality of ink types into consideration, i.e. based on an idea of prolonging the service life of a heat generating section against easily koge. Generating ink and highly corrosive ink by using different materials is admitted, materials partly varying in an anti-cavitation film are not limited to two types but three types or more are allowable.

Hereinafter, referring to the drawings, embodiments of the present invention will be described.

Embodiment 1

Figure 1B:
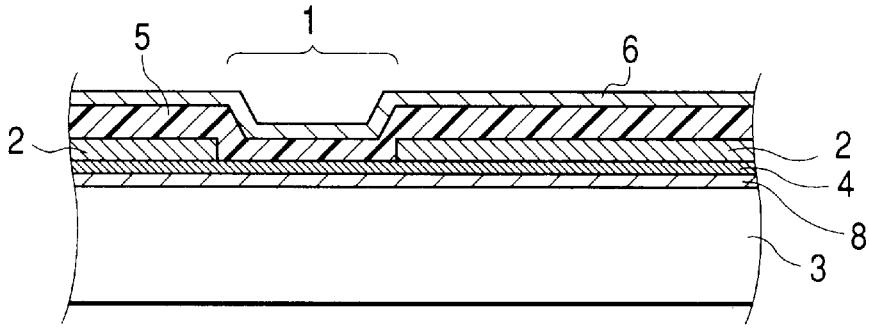
Figure 1C:
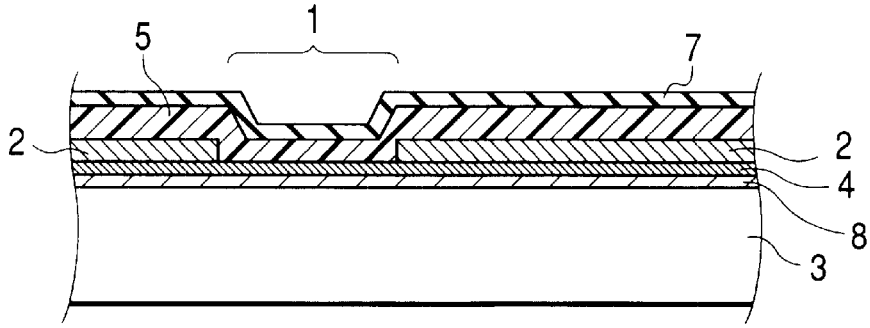

FIGS. 1A to 1C show an ink-jet head substrate according to Embodiment 1 of the present invention, where FIG. 1A is a schematic top view showing the principal part of the head substrate, FIG. 1B is a schematic sectional view sectioned along a one-point chained line IB—IB in FIG. 1A and FIG. 1C is a schematic sectional view sectioned along a one-point chained line IC—IC in FIG. 1A.

As shown in FIGS. 1A to 1C, a silicon oxide film is formed as a heat accumulating layer 8 on a Si substrate 3, on which Al layers are formed in the respective forms of given patterns as a heat generating resistor layer 4 and electrode wires 2. The portion of a heat generating resistor layer 4 in the gap between a pair of electrode wires 2 undertakes a heat generating section 20 for abruptly heating and boiling the top superficial ink.

As if covering these heat generating resistor layer 4 and electrode wires 2, a silicon nitride layer is formed as the protective film 5 for keeping the insulation principally between the electrodes 2 and further a layer of anti-cavitation film composed of at least two types of materials is formed thereon. As shown in FIG. 1A, this head substrate commands the heat generating section 1 properly in accordance with different types of ink (in this example, yellow, magenta and cyan color ink). Such being the case, in this example, a first anti-cavitation film 6 is formed at the yellow area Y and the magenta area M, whereas a second anti-cavitation film 7 is formed at the cyan area C.

Especially, in case of using cyan ink high in corrosion and using yellow and magenta ink relatively liable to generate koge., a Ta-containing amorphous alloy film is formed as a second anti-cavitation film 7 in the cyan area and a Ta film lower in ink corrosion resistance than the second anti-cavitation film 7 is employed as a first anti-cavitation film 6 at the yellow and magenta areas.

In this embodiment, Ta is employed as the first anti-cavitation film 6, relatively good in koge. characteristic, but TaAl is also employed likewise.

Besides, a Ta-containing amorphous alloy as a second anti-cavitation film 7 is composed of Ta, Fe, Ni and Cr. Such an alloy implements a high level of ink corrosion resistance. Besides, such an alloy may contain one or more metal elements selected from a group comprising Ti, Zr, Hf, Nb and W.

Furthermore, the above amorphous alloy is preferably a Ta-containing amorphous alloy expressed in terms of the composition formula (I): $Ta_{\alpha}Fe_{\beta}Ni_{\gamma}Cr_{\delta}$, wherein 10 at. $\% \leqq \alpha \leqq 30$ at. %, $\alpha+\beta<80$ at. %, $\alpha<\beta$, $\delta>\gamma$ and $\alpha+\beta+\gamma+\delta=100$ at. %. In this case, the quantity of Ta is set to a lower range as of 10 at. % to 30 at. % than that of the Ta-containing amorphous alloy composed above. By adopting such a low Ta ratio, a moderate extent of amorphous area is afforded to the alloy to make a passive film, thus significantly decreasing the sites in presence of crystal interfaces serving as the initiating points of corrosion reaction, so that the resistance against ink corrosion can be improved while keeping the anti-cavitation characteristic to a good level. Especially, to ink as contains a divalent metal such as Ca or Mg or a component forming a chelate complex, an effect as a passive film is fully exhibited and the corrosion due to ink can be prevented. A value of $\alpha$ in the above composition formula well preferably satisfies 10 at. $\% \leqq \alpha \leqq 20$ at. %. In addition, it is more preferable that $\gamma \geqq 7$ at. % and $\delta \geqq 15$ at. % and it is still more preferable that $\gamma \geqq 8$ at. % and $\delta \geqq 17$ at. %.

Besides, aside from the case where the second anti-cavitation film 7 is set to a Ta-containing amorphous alloy film like this embodiment, using those having similar resistance against ink corrosion, e.g. using an anti-cavitation film with an oxide film which contains a Cr oxide formed on the surface thereof exhibits like effect.

Next, a method for manufacturing an ink-jet head substrate having the structure mentioned above will be described referring to FIGS. 2A to 2F and FIGS. 3A to 3D. FIGS. 2A to 2F are illustrations of film-forming steps viewed in the section along line IB—IB shown in FIG. 1A and FIGS. 3A to 3D are illustrations of film-forming steps viewed in the section along line III—III shown in FIG. 1A.

Figure 2A:
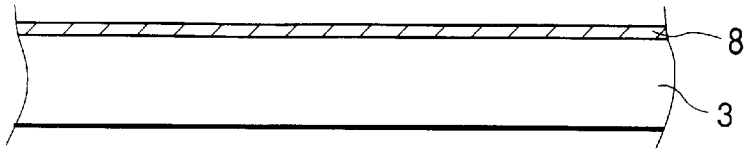
FIGS. 2A, 2B, 2C, 2D, 2E and 2F are illustrations of manufacturing steps of the ink-jet head substrate, viewed in a section IB—IB of FIG. 1A.

As shown in FIG. 2A, a silicon oxide film undertaking a heat accumulating layer 8 as the underlying part of a heat generating resistor is formed at a thickness of 2400 nm on the Si substrate 3 by the thermal oxidation process, by the sputtering process, by the CVD process and the like.

Figure 2B:
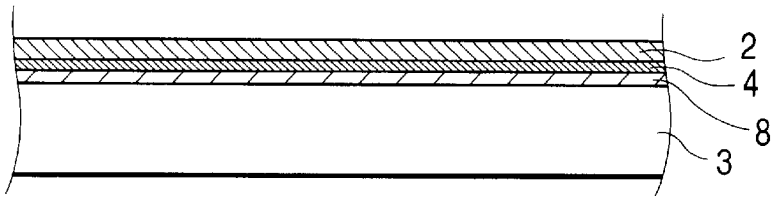

Then, on the heat accumulating layer 8, as shown in FIG. 2B, a TaN layer undertaking the heat generating resistor layer 4 is formed at a thickness of approximately 100 nm by the reactive sputtering and Al layers undertaking the electrode wires 2 is formed at a thickness of 500 nm by the sputtering.

Figure 2C:
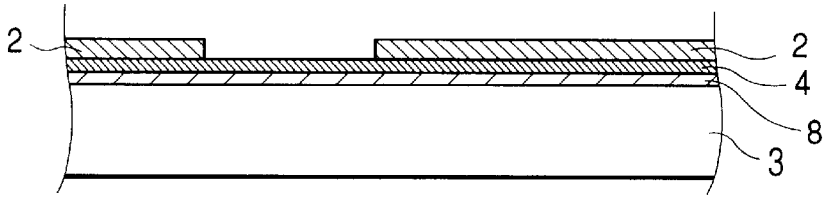

Next, using the photolithography process, the Al layers are subjected to wet etching and further the TaN layer is subjected to reactive etching to form electrode wires 2 and a heat generating resistor layer 4 whose sectional shapes assume those of FIG. 2C (regarding the planar shapes, refer to FIG. 1A). The heat generating section 1 shown in FIGS. 1A to 1C is a removed portion of the Al layer on the heat generating resistor layer 4 and generates the heat to be afforded to ink when current flows between the electrode wires 2.

Figure 2D:
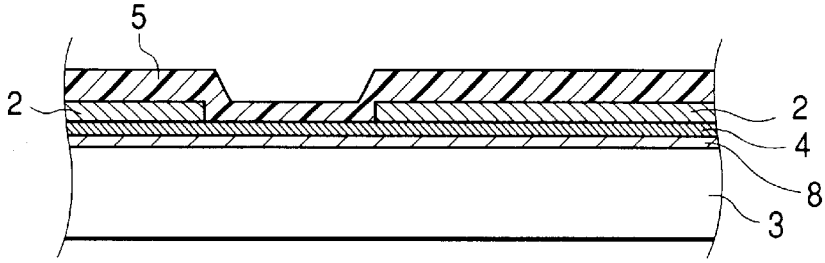
Figure 2E:
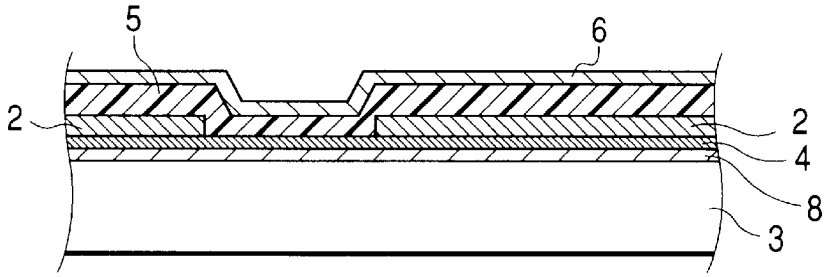

Next, as shown in FIG. 2D, a silicon nitride film is formed as the protective film 5 at a thickness of 1000 nm by the CVD process.

The film section obtained by the heretofore steps is entirely identical in the areas of yellow, magenta and cyan shown in FIG. 1A.

Figure 3A:
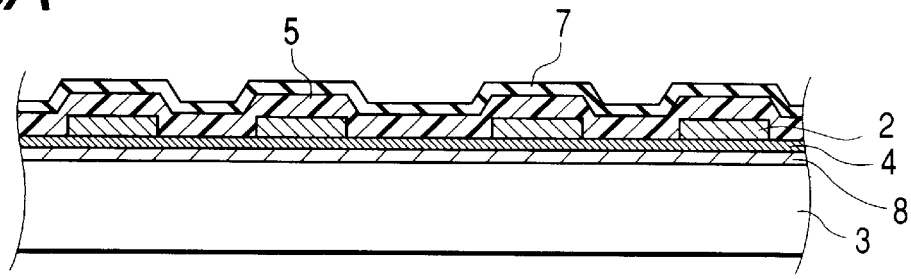
FIGS. 3A, 3B, 3C and 3D are illustrations of film forming steps between an area different in material for an anti-cavitation film of the ink-jet head substrate, viewed in a section III—III of FIG. 1A.

Next, different anti-cavitation films will be formed in every group of a plurality of areas on one and the same substrate. First, all over the surface of the protective film 5, as shown in FIG. 3A, a Ta-containing amorphous alloy film composed of Ta: approximately 18 at. %; Fe: approximately 60 at. %; Cr: 13 at. %; and Ni: approximately 9 at. % in constituents is formed at a thickness of approximately 100 nm as the second anti-cavitation film 7 by the sputtering process. The film formation of this Ta-containing amorphous alloy film 7 can be formed not only by the sputtering process using an alloy target comprising Ta—Fe—Cr—Ni but also by the binary simultaneous sputtering process separately using a Ta target and a Fe—Cr—Ni target to apply separate power from two power sources respectively connected to the targets.

Figure 3B:
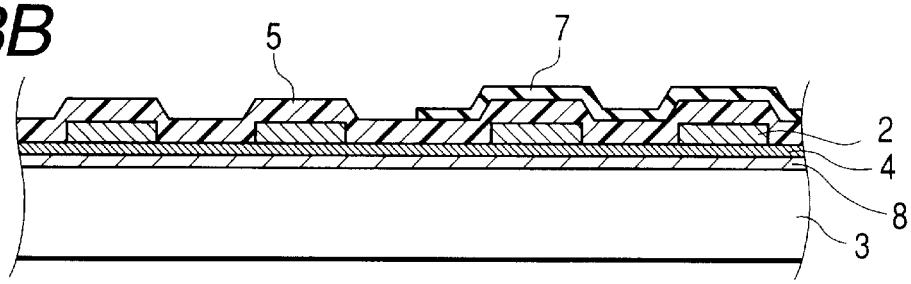

Then, using the photolithography process, a resist pattern is formed on the Ta-containing amorphous alloy 7 and etched by using an etching solution based on hydrofluoric acid and nitric acid to make a given shape as shown in FIG. 3B. Here, the yellow and magenta areas shown in FIG. 1A are chosen as those to be etched in this embodiment.

Figure 3C:
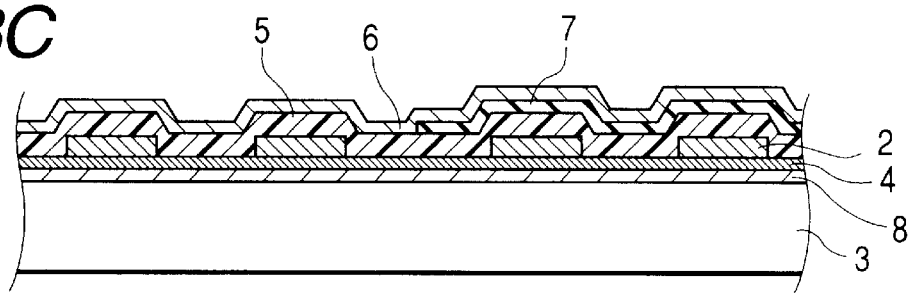

Furthermore, as shown in FIG. 3C, a Ta film is formed at a thickness of approximately 150 nm as the first anti-cavitation film 6 by the sputtering process.

Figure 3D:
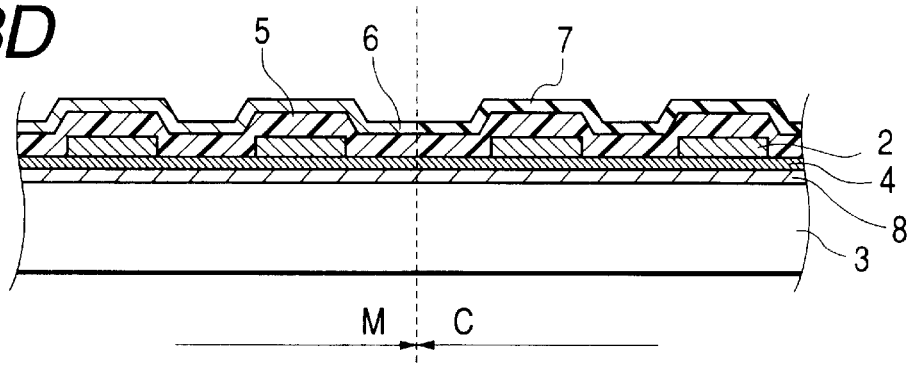

Next, using the photolithography process, as shown in FIG. 3D, a resist pattern (this pattern coincides with the yellow and magenta areas shown in FIG. 1A) is formed on the Ta film 6 and the Ta film 6 is etched by the dry etching process based on the $CF_4$ gas. Here, the Ta film 6 on the Ta-containing amorphous alloy film 7 formed before must be etched, while the Ta-containing amorphous alloy layer, high in corrosion resistance, is not damaged on the surface even if the Ta etching proceeds and reaches the interface between the Ta-containing amorphous alloy layer 7 and the Ta film 6 during the above dry etching. In FIG. 3D, reference symbols M and C denote the magenta area and the cyan area, respectively.

Figure 2F:
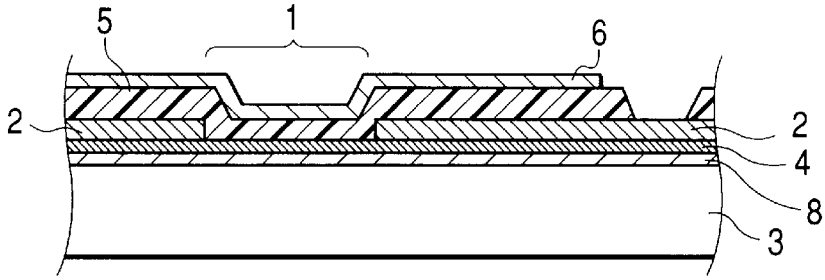

Subsequently, as shown in FIG. 2F, the anti-cavitation film 6 is etched to expose part of the protective film 5 and a resist pattern is formed on the protective film 5 by the photolithography process, then an electrode pad made of an Al electrode necessary the connection to an external power source is exposed by the dry etching process using the $CF_4$ gas to complete the manufacturing of the principal part of the ink-jet head substrate. Meanwhile, the steps shown in FIGS. 2A to 2F are the manufacturing steps viewed in the section along line IB—IB of FIG. 1A, but they become identical with the steps viewed in the section along line IC—IC of FIG. 1A if the first anti-cavitation film 6 in FIGS. 2E and 2F converted into the second anti-cavitation film 7.

Incidentally, like U.S. Pat. No. 4,429,321, the IC circuit for driving a heat generating resistor may be incorporated in one and the same Si substrate. In this case, as with the wiring part, the IC circuit part is covered preferably with the protective film 5, the first anti-cavitation film 6 and the second anti-cavitation film 7.

Using the ink-jet head substrate manufactured thus, an ink-jet head (e.g. see the head of FIG. 5) is fabricated, the nozzle array formed on one and the same substrate is divided into three, to individual portions of which cyan ink, high in corrosion to Ta and yellow and magenta ink, relatively liable to generate accumulated koge. are supplied to confirm their head performance. Then, no breakage of a heater occurred at a heater portion in which cyan ink was used, whereas hardly any koge. is generated and no decrease in discharge power was observed at the other heater portion in which yellow ink and magenta ink were used. As a result, the service life of a head could be secured till near 1*10E9 pulse duration.

That is, at the heat generating section of an area in which easily koge. Generating ink is used on the head substrate, according to Embodiment 1, use of Ta as the material of an anti-cavitation film in contact with ink prevents the accumulated generation of koge. on account of little-by-little scraping of the Ta film surface accompanying an increase in heater driving pulse, so that the efficiency of bubbling does not fall. On the other hand, at the heat generating section of an area where highly corrosive ink is used on the head substrate, a Ta-containing amorphous alloy is used as the material of an anti-cavitation film, so that hardly any corrosion takes place. Thus, in case of divisively using a plurality of heat generating sections arrayed in a straight line on a head substrate depending on individual ink types, the head substrate can attain a sufficient service life and the reliability compatibly for both following ink types, even if the ink types used then include easily koge. Generating ink and highly Ta corrosive ink.

Embodiment 2

In Embodiment 1, an arrangement that film materials vary with areas corresponding to individual ink types in a single layer anti-cavitation was adopted, but here, an embodiment that an anti-cavitation layer is formed all over the surface of an insulator protective film and an anti-cavitation film made of different material is formed only in a specific ink area thereon will be described.

Figure 4A:
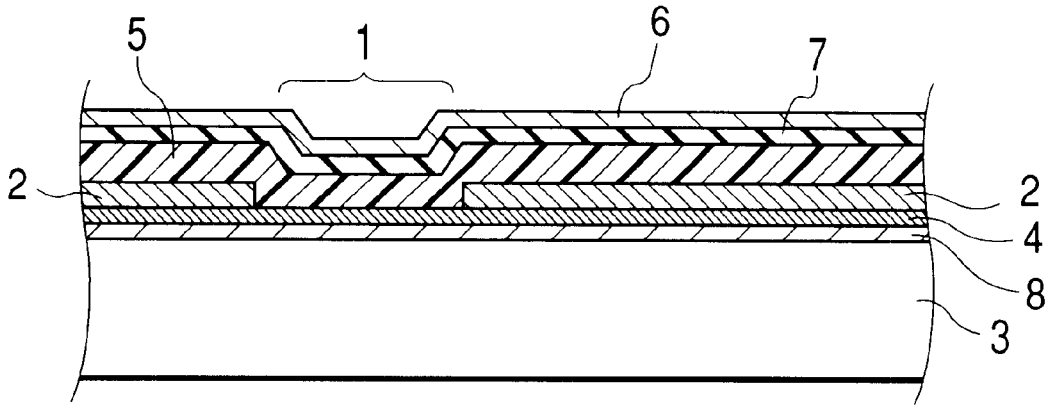
FIGS. 4A and 4B are illustrations of an ink-jet head substrate according to Embodiment 2 of the present invention.
Figure 4B:
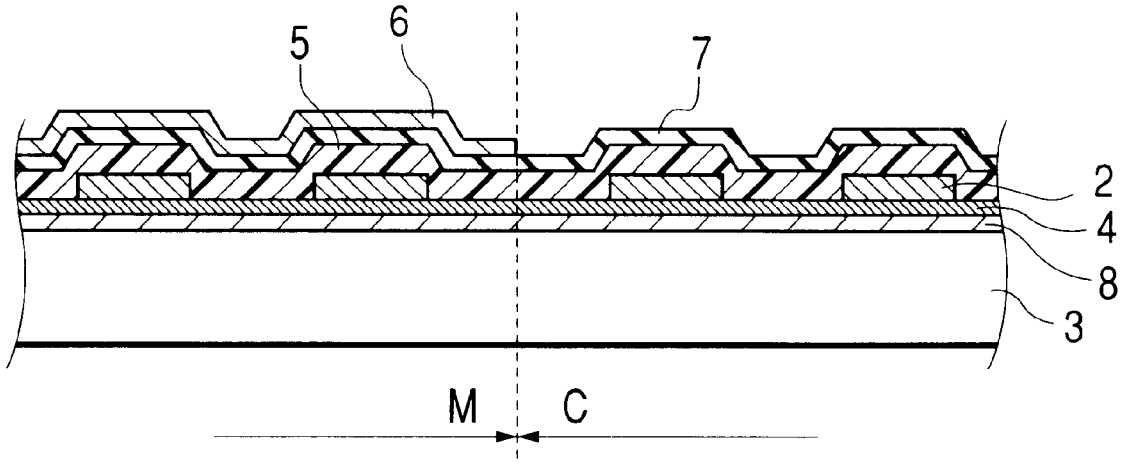

FIGS. 4A and 4B are sectional views illustrating the principal part of an ink-jet head substrate according to Embodiment 2 of the present invention, wherein FIG. 4A shows the section of this embodiment corresponding to the section along line IB—IB in FIG. 1A and FIG. 4B shows the section of this embodiment corresponding to the section along a line III—III in FIG. 1A. Incidentally, reference symbols M and C denote a magenta area and a cyan area, respectively.

In FIGS. 4A to 4C, as a second anti-cavitation film 7, a Ta-containing amorphous alloy film, high in ink corrosion resistance, is formed all over the surface of a protective film 5 keeping the insulation, on which a relatively good koge. characteristic Ta film is formed as a first anti-cavitation film 6 an insulator protective layer only to the yellow and cyan areas relatively liable to generate koge.

According to such an embodiment, since the progress of corrosion accompanying an increase in driving pulse stops at the interface between the Ta-containing amorphous alloy film 7 and the Ta film 6 even if the yellow and magenta ink changes into one containing a highly Ta corrosive component midway during the use, the service life of heat generating sections can be maintained.

Incidentally, in this embodiment, the area corresponding to cyan ink on the head substrate was set to a Ta-containing amorphous alloy film, still higher in ink corrosion resistance, and the areas corresponding to yellow and magenta ink were set to a two-layered film comprising a Ta-containing amorphous alloy film for the lower layer and a Ta film, lower in ink corrosion resistance, for the upper layer, but positions at which the area of the single-layered Ta-containing amorphous alloy film and the areas comprising a Ta-containing amorphous alloy film for the lower layer and a Ta film for the upper layer are appropriately altered corresponding to the area using ink liable to generate koge. and that using ink liable to corrode Ta.

Embodiment 3

Hereinafter, an ink-jet head and an ink-jet recording apparatus to which an ink-jet head substrate according to the present invention is applicable will be described.

Figure 5:
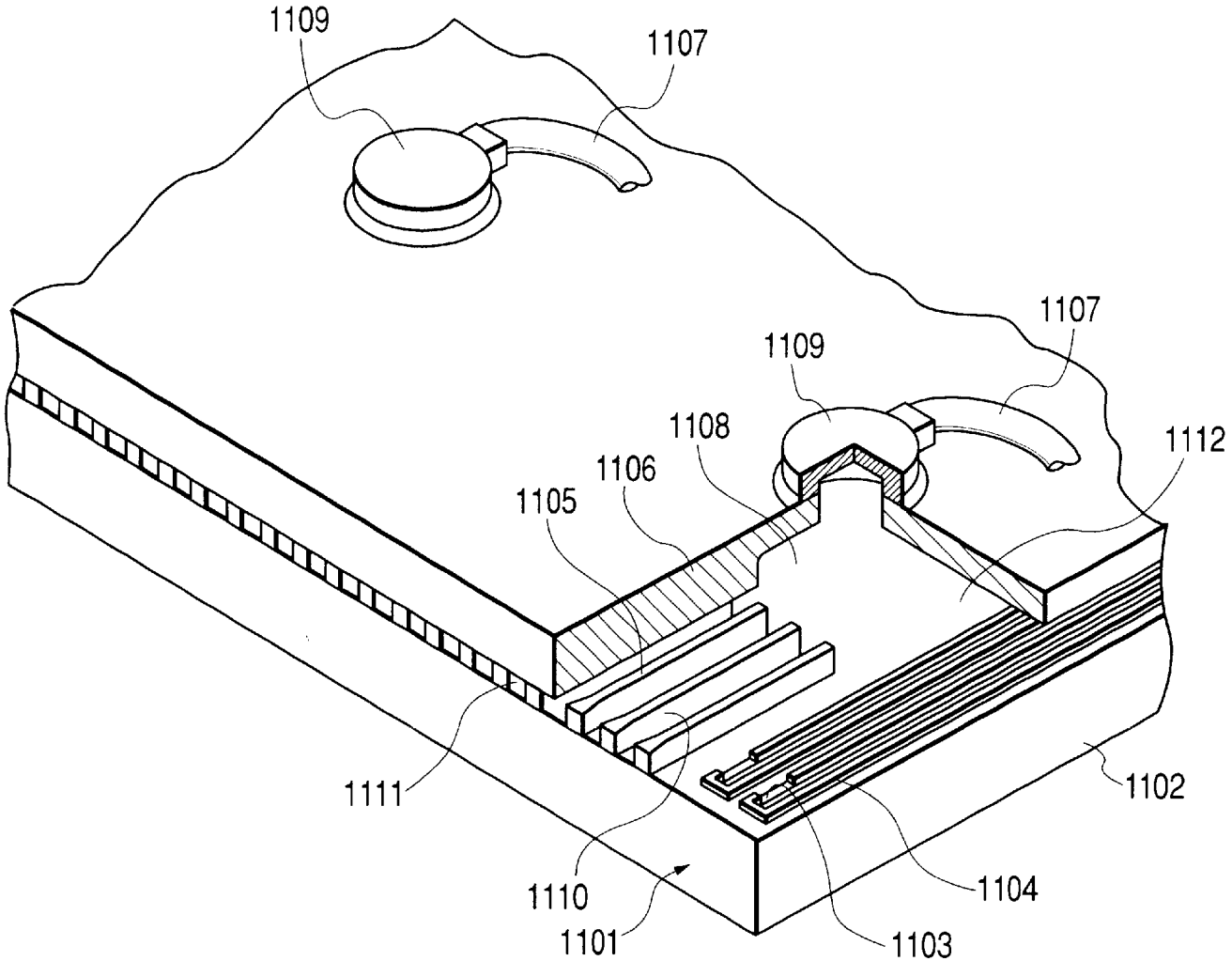
FIG. 5 is a sectional view of a cutaway principal part of an ink-jet head fabricated using a head substrate according to Embodiments 1 and 2 of the present invention.

FIG. 5 is a perspective view of the cutaway principal part of an ink-jet head fabricated using a head substrate according to Embodiment 1 or Embodiment 2. FIG. 5 shows an ink-jet head 1101 comprising heat generating resistors 1103, wire electrodes 1104, liquid path walls 1110 and a ceiling plate 1106 formed in the shape of respective films via semiconductor process steps such as etching and vapor deposition/sputtering on a head substrate 1102 according to Embodiment 1 or Embodiment 2.

A recording liquid 1112 is supplied from an unillustrated liquid store chamber through a liquid supply pipe 1107 into a common liquid chamber 1108 of the head 1101. In FIGS. 4A and 4B, reference numeral 1109 denotes a connector for the liquid supply pipe. The liquid 1112 supplied into the common liquid chamber 1108 is supplied into a liquid path by means of capillarity and retained stably by forming a meniscus at the discharge port face (orifice face) of the liquid path tip. Besides, an electro-thermal converter 1103 is disposed for each liquid path. Each liquid path is formed by joining the liquid path walls 1110 on the head substrate 1102 to the ceiling plate 1106. Besides, connectors 1109 for the liquid supply pipe as mentioned above and a plurality of liquid paths for communicating the common liquid chamber 1108 thereto are classified according to individual types (e.g. colors) of recording ink on one and the same head substrate.

Here, by the current passage through an electro-thermal converter 1103, the liquid on the electro-thermal converter surface is steeply heated, bubbles are generated in the related flow path and a liquid is discharged from the related discharge port 1111 by the expansion/contraction of the bubbles to form a droplet.

Figure 6:
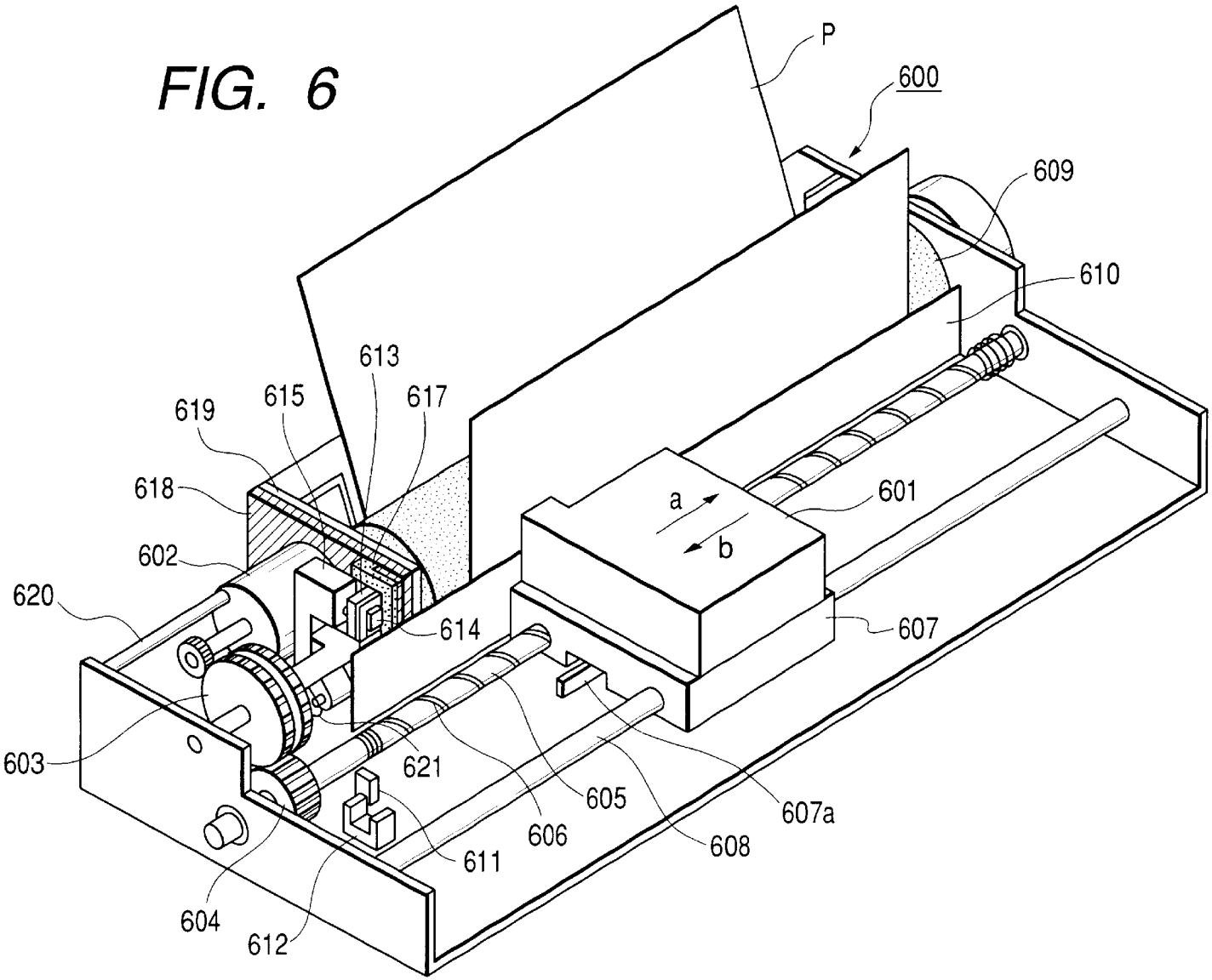
FIG. 6 is a schematic perspective view showing a principal part of an ink-jet recording apparatus to which the present invention is applied.

FIG. 6 is a schematic perspective view showing the principal part of an ink-jet recording apparatus to which the present invention is applied. The head cartridge 601 mounted on the ink-jet apparatus 600 shown in FIG. 6 comprises a liquid discharge head for discharging ink for the character print recording and a plurality of color ink tanks for retaining the liquid supplied to the liquid discharge head.

As shown in FIG. 6, the head cartridge 601 is mounted on a carriage 607 disengaging with the spiral groove 606 of a lead screw 605 rotating via driving force transmission gears 603 and 604 in answer to the normal/reverse rotation of a driving motor 602. By the motive power of the driving motor 602, the head cartridge 601 is reciprocated together with the carriage 607 along a guide 608 in the direction of arrowheads a and h. The ink-jet recording apparatus 600 is equipped with recording medium conveyance means (unillustrated) for conveying print sheets P as recording medium for receiving the liquid such as ink discharged from the head cartridge 601. The sheet clamp plate 610 of print sheets P conveyed over a platen 609 by the recording medium conveyance means presses print sheets P against the platen 609 throughout the traveling direction of the carriage 607.

Near one end of the lead screw 605, photo-couplers 611 and 612 are disposed. The photo-couplers 611 and 612 are home position detection means for ensuring the presence of the lever 607*a* of the carriage 607 in the area of photo-couplers 611 and 612 and accomplishing the switchover of the rotating direction or the like of the driving motor 602. Provided near one end of the platen 609 is the support material 613 for supporting a cap member 614 concealing the front surface on which the discharge port of the head cartridge 601 is positioned. Besides, ink absorption means 615 for absorbing the ink accumulated inside the cap member 614 due to the lost discharge or the like from the head cartridge 601 is provided. By this ink absorption means 615, the absorption recovering of the head cartridge 601 is accomplished via the opening of the cap member 614.

The ink-jet recording apparatus 600 is equipped with a body supporter 619. On this body supporter 619, a traveling member 618 is supported movably back and forth, i.e. at a right angle to the traveling of the carriage 607. The traveling member 618 is equipped with a cleaning blade 617. The cleaning blade 617 is not limited to this shape, but publicly-known cleaning blades of other shapes are allowable. Furthermore, in the absorption recovering operation by the ink absorption means 615, a lever 620 for initiating the absorption is provided. The lever 620 moves with the travelling of the cam 621 disengaging with the carriage 607 and the driving force from the driving motor 602 is controlled in travelling by publicly-known transmission means-such as clutch switching. The ink-jet recording control for applying a signal to a heat generating body installed on the head cartridge 601 or managing the drive control of the above individual mechanisms is provided at the side of a recorder body and is not illustrated in FIG. 6.

With the ink-jet recording apparatus 600 having the above configuration, the head cartridge 601 travels reciprocally over the whole width of a print sheer P to the print sheet P conveyed on the platen 609 by the above recording medium conveyance means. When a driving signal is supplied from unillustrated driving signal supply means to the head cartridge 601 during this travelling, ink (recording liquid) is discharged from the liquid discharge head section to a recording medium in response to this signal and recording is carried out.

According to the present invention, as described above, the anti-cavitation film provided via an insulator protective layer on a heat generating resister and electrode wires on a base was composed divisively of a Ta film or TaAl film and of a Ta-containing amorphous alloy film for individual areas corresponding to given ink types.

Thereby, at the heat generating sections of the areas in which koge. liable ink is used on the head substrate, since the Ta film surface is little by little scraped with an increase in heater driving pulses to prevent the accumulated generation of koge., the efficiency of bubbling does not fall. On the other hand, at the heat generating sections of the areas in which highly corrosive ink is used on the head substrate, hardly any corrosion takes place on account of the presence of a Ta-containing amorphous alloy. Thus, in case of divisively using a plurality of heat generating sections arrayed in a straight line on a head substrate depending on individual ink types, the head substrate can attain a sufficient service life and the reliability compatibly for both following ink types, even if the ink types used then include koge. liable ink and highly Ta corrosive ink.

What is claimed is:

1. An ink-jet head comprising:

an ink-jet head substrate provided with a plurality of heat generating resistors forming a heat generating section on a base, a plurality of electrode wires electrically connected to said plurality of heat generating resistors, and an insulator protective layer for covering said heat generating resistors and said electrode wires;

a first liquid path communicating with a discharge port for discharging a first ink droplet of a first ink and provided corresponding to the heat generating section; and a second liquid path communicating with a discharge port for discharging a second ink droplet of a second ink different from the first ink and provided correspondingly to the heat generating section, wherein a plurality of anti-cavitation films are provided at an area corresponding to said heat generating section on said insulator protective layer, and wherein an anti-cavitation film provided for said first liquid path and an anti-cavitation film provided for said second liquid path are formed from different materials.

2. The ink-jet head according to claim 1, wherein said anti-cavitation film provided for said first liquid path is formed from a Ta film or a TaAl film, and said anti-cavitation film provided for said second liquid path is formed from a Ta-containing amorphous alloy.

3. The ink-jet head according to claim 2, wherein said Ta-containing amorphous alloy is comprised of Ta, Fe, Ni and Cr.

4. The ink-jet head according to claim 3, wherein said Ta-containing amorphous alloy is expressed in terms of Composition Formula (I):

$$Ta_{\alpha}Fe_{\beta}Ni_{\gamma}C_{\delta} \quad (I),$$

wherein 10 at. %$\leqq\alpha\leqq$30 at. %, $\alpha+\beta<80$ at. %, $\alpha<\beta$, $\delta>\gamma$ and $\alpha+\beta+\gamma+\delta=100$ at. %.

5. The ink-jet head according to claim 2, wherein said first ink tends to generate kogation compared with said second ink.

6. An ink-jet head comprising:

an ink-jet head substrate provided with a plurality of heat generating resistors forming a heat generating section on a base, a plurality of electrode wires electrically connected to said plurality of heat generating resistors, and an insulator protective layer for covering said heat generating resistors and said electrode wires;

a first liquid path communicating with a discharge port for discharging a first ink droplet of a first ink and provided correspondingly to the heat generating section; and a second liquid path communicating with a discharge port for discharging a second ink of a second ink droplet different from the first ink and provided correspondingly to the heat generating section, wherein a plurality of anti-cavitation films are provided at an area corresponding to said heat generating section on said insulator protective layer, and wherein an anti-cavitation film provided for said first liquid path is different in ink corrosion resistance from an anti-cavitation film provided for said second liquid path.

7. The ink-jet head according to claim 6, wherein said anti-cavitation film provided for said first liquid path is formed from a Ta film or a TaAl film and said anti-cavitation film provided for said second liquid path is formed from a Ta-containing amorphous alloy.

8. An ink-jet head according to claim 7, wherein said first ink tends to generate kogation compared with said second ink.

9. An ink-jet head, said ink-jet head being supplied with a first ink containing either a divalent metal or a chelate-complex forming component, and a second ink different from said first ink, and containing neither a divalent metallic salt nor a chelate-complex forming component, comprising:

a plurality of discharge ports provided individually for each type of said first or second ink for discharging droplets;

a plurality of ink flow paths communicating with said plurality of discharge ports;

a plurality of heat generating resistors forming the heat generating sections disposed in said ink flow paths;

a plurality of electrode wires electrically connected to said heat generating resistors; and a plurality of anti-cavitation films for coating said heat generating resistors and said electrode wires on an insulating protective layer, wherein said plurality of anti-cavitation films have different ink corrosion properties, at least one of said plurality of anti-cavitation films covering heat generating resistors for discharging said first ink, said first ink containing either a divalent metal or a chelate-complex forming component, and at least one of said plurality of anti-cavitation films covering said heat generating resistors for discharging said second ink, said second ink containing neither a divalent metal nor a chelate-complex forming component, and wherein an anti-cavitation film provided for a first one of said ink flow paths and an anti-cavitation film provided for a second one of said ink flow paths are formed from different materials.

10. The ink-jet head according to claim 9, wherein said at least one anti-cavitation film covering said heat generating resistors for discharging said first ink containing either a divalent metal or a chelate-complex forming component is formed of a Ta-containing amorphous alloy, and said at least one anti-cavitation film covering said heat generating resistors for discharging said second ink containing neither a divalent metal nor a chelate-complex forming component is formed of either Ta film or TaAl film.

11. The ink-jet recording apparatus comprising a carriage, said carriage mounting an ink-jet head according to any one of claims 1 to 10, in which ink droplets are discharged from the ink-jet head to record on a print medium while the carriage travels corresponding to recording information.

12. An ink-jet head, said ink-jet head being supplied with a first ink containing either a divalent metal or a chelate-complex forming component, and a second ink different from said first ink, and containing neither a divalent metallic salt nor a chelate-complex forming component, comprising:

a plurality of discharge ports provided individually for each type of said first or second ink for discharging droplets;

a plurality of ink flow paths communicating with said plurality of discharge ports;

a plurality of heat generating resistors forming the heat generating sections disposed in said ink flow paths;

a plurality of electrode wires electrically connected to said heat generating resistors; and a plurality of anti-cavitation films for coating said heat generating resistors and said electrode wires on an insulating protective layer, wherein said plurality of anti-cavitation films have different ink corrosion properties, at least one of said plurality of anti-cavitation films covering heat generating resistors for discharging said first ink, said first ink containing either a divalent metal or a chelate-complex forming component, and at least one of said plurality of anti-cavitation films covering said heat generating resistors for discharging said second ink, said second ink containing neither a divalent metal nor a chelate-complex forming component, and wherein an anti-cavitation film provided for a first one of said ink flow paths is different in ink corrosion resistance from an anti-cavitation film provided for a second one of said liquid flow paths.

* * * * *

UNITED STATES PATENT AND TRADEMARK OFFICE

CERTIFICATE OF CORRECTION

PATENT NO. : 6,644,790 B2
DATED : November 11, 2003
INVENTOR(S) : Teruo Ozaki et al.

It is certified that error appears in the above-identified patent and that said Letters Patent is hereby corrected as shown below:

Column 2,
Line 39, “film” should read -- films --.

Column 5,
Line 6, “koge. Generating” should read -- koge generating --.

Column 7,
Line 27, “necessary” should read -- necessary for --;
Line 35, “converted” should read -- is converted --; and
Line 56, “koge. Generating” should read -- koge generating --.

Column 8,
Line 4, “koge. Generating” should read -- koge generating --.

Column 10,
Line 12, “sheer P” should read -- sheet P --.

Column 12,
Line 26, “claim 1 to 10,” should read -- claims 1 to 4, 6, 9, and 10, --.

Signed and Sealed this

Twenty-seventh Day of July, 2004

JON W. DUDAS
*Acting Director of the United States Patent and Trademark Office*